US005152684A

United States Patent [19]

Steffens

[11] Patent Number: 5,152,684

[45] Date of Patent: Oct. 6, 1992

[54] ROTOR PROFILE FOR A ROOTS VACUUM PUMP

[75] Inventor: Ralf Steffens, Köln, Fed. Rep. of Germany

[73] Assignee: Leybold Aktiengesellschaft, Fed. Rep. of Germany

[21] Appl. No.: 750,322

[22] Filed: Aug. 27, 1991

[30] Foreign Application Priority Data

Aug. 27, 1990 [EP] European Pat. Off. ..... 90116357

[51] Int. Cl.[5] ..... F04C 18/12

[52] U.S. Cl. ..... 418/150; 418/206

[58] Field of Search ..... 418/150, 205, 206

[56] References Cited

U.S. PATENT DOCUMENTS

| | | | |
|---|---|---|---|
| 3,089,638 | 5/1963 | Rose | 418/150 |
| 4,938,670 | 7/1990 | Lee | 418/150 |
| 5,040,959 | 8/1991 | Fukagawa | 418/150 |

FOREIGN PATENT DOCUMENTS

| | | |
|---|---|---|
| 1503579 | 3/1970 | Fed. Rep. of Germany . |
| 100312 | 12/1973 | Fed. Rep. of Germany . |
| 389817 | 7/1965 | Switzerland . |

OTHER PUBLICATIONS

Niemann and Winter, *Maschinenelemente*, vol. 2, 1985, p. 42.

*Primary Examiner*—John J. Vrablik
*Assistant Examiner*—David L. Cavanaugh
*Attorney, Agent, or Firm*—Wall and Roehrig

[57] ABSTRACT

A dual rotor Roots type vacuum pump has an improved rotor profile contour resulting in high area efficiency, high volumetric efficiency, reduced backstreaming and simplified economical manufacturing which yields a compact, cost effective pump.

5 Claims, 4 Drawing Sheets

ROTOR PROFILE FOR A ROOTS VACUUM PUMP

BACKGROUND OF THE INVENTION

1. Field of the Invention

The present invention relates to a rotor for a Roots vacuum pump with two identical rotors having basically a figure-of-eight profile contour composed of four profile sections at the base and four profile sections at the top.

2. Description of the Related Art

Roots vacuum pumps of this type have found wide spread use. The rotary motion of the rotors which rotate at the same speed is synchronized by a gear so that they are near to one another and to the housing without actual contact. The rotors are not subject to mechanical wear and may be operated at high speeds. The gap which remains between the wall of the housing and the rotors, and between the rotors themselves is usually in the order of several tenths of a millimeter.

Shown in FIGS. 1-4 are sections through known rotors or pairs of rotors of Roots vacuum pumps of the aforementioned type. Shown in FIG. 1*a* is a rotor profile contour developed from an involute. The rotor profile contour according to FIG. 1*b* is disclosed in CH-PS 389 817 (FIGS. 3, 6, "straight" rotors). The profile contour according to FIG. 1*c* contains sections, the shape of which corresponds to that of a cycloid. Shown once more in FIGS. 2, 3 and 4 is the profile contour according to FIG. 1*a*. The letters and numbers in the figures indicate the following:

1: Rotors
2: Rotational axes of the rotors
3: Short axis of the rotors
4: Long axis of the rotors
5: Rolling cycle
6: Profile at the base of the rotor (rotor contour within rolling cycle 5)
7: Profile at the top of the rotor (rotor contour outside rolling cycle 5)
8,9: Profile sections at the base
11,12: Profile sections at the top
13: Envelope or contour of the pumping chamber
1: Rolling cycle diameter or distance between the rotational axes 2
B: Shorter diameter of the rotor (waist)
C: Point of osculation of rolling cycles 5
D: Longer diameter of the rotor
E1-E4: Lines of action
F: Effective pumping area of the rotor
Q: Cross sectional area of the pumping chamber
to,t: Tangents to a "point of contact"
x,y: Fixed system of coordinates referenced to the rotor (FIG. 4)
xf,yf: Fixed system of coordinates referenced to the housing (FIG. 3)
$\rho$: Angle of rotation
a ($\rho$): Angle of inclination of the tangent to the profile contour at the "point of contact" of both rotors in the x/y system of coordinates.

FIGS. 2, 3 and 4 show that the profile contour of rotor 1 is composed of four profile sections at the base 8, 9 and four profile sections at the top 11, 12. Profile sections 8, 9 extend from the actual base (where the contour intersects the short rotor axis 3) to the intersect of the contour with rolling cycle 5. The four sections of the base form equal pairs (pairs 8, 8 and 9, 9) and symmetrical pairs (pairs 8, 9). The profile sections at the top extend from the intersect with long rotor axis 4 to the intersect with rolling cycle 5. The top sections also form equal pairs (pairs 11, 11 and 12, 12) and symmetrical pairs (pairs 11,12). The profile contours shown in FIGS. 1*a* and 2 to 4 correspond to state of the art rotors (involute), which are being used widely in vacuum technology.

At any rotor position in the pumping chamber there is always a point where they come closest. In the following this point is termed "point of contact", although the rotors do not actually come in to contact. At the "point of contact" the narrowed gap is formed by a point on the profile section of the base of the first rotor and a point on the corresponding profile section at the top of the second rotor. In a Cartesian system of x/y coordinates referenced to the rotor (FIG. 4) there is a value $$f(\rho)=Y(\rho)=a(\rho)$$

which corresponds to each angle of rotation $\rho$.

a($\rho$) is the angle of inclination of the tangent to the "point of contact" on the profile contour. For example, at an angle of rotation of $\rho=0$ the inclination of tangent $t_0$ to the "point of contact" of the profile contour is equal to 0 (FIG. 3).

during operation of the pump or while the rotor is rotating, the "point of contact" moves along a closed path.

The typical line of action for rotor profile contours according to FIGS. 1*a*, 2 to 4 (involute) is shown in FIG. 3 and marked as $E_1$. It has a shape similar to a figure-of-eight with a centre which is marked C. The line of action $E_1$ is shown in a fixed system of coordinates $x_f$, $y_f$, related to the stationary housing, the origin of which is located on axis 2 of a rotor. The system of coordinates xf, yf, is drawn into FIG. 3.

A characteristic quantity which describes the characteristic of a Roots pump of the described type is the efficiency of area $\mu$, which is defined as the ratio between four times the effective pumping area F of the rotor and the cross sectional area Q of pumping chamber 13. The volume V pumped during each half-turn of the rotors is equal to the product of effective pumping area F of the rotor and length l of pumping chamber 13, so that the following applies the amount of gas which can be theoretically pumped (pumping speed):

$$Q_{th}=4\cdot V\cdot n=4\cdot F\cdot l\cdot n$$

where n is the speed of the rotors. For a given cross sectional area Q and with increasing values of F (and thus V) the efficiency of area $\mu$ will increase and thus $Q_{th}$. At a given pumping speed a high efficiency of area $\mu$ will lead to small and compact Roots vacuum pumps, with a direct effect on the material and production costs and hence the price of the pump.

A further characteristic quantity used to describe a Roots vacuum pump is volumetric efficiency $\eta$. This quantity is defined as the ratio between the effectively pumped quantity of gas $Q_{off}$ and the Quantity of gas $Q_{th}$ which can be pumped theoretically. Because of the gaps which are an inherent design feature of a Roots vacuum pump of the type described here (non-contact movement of the rotors) backstreaming of gas is unavoidable and therefore $Q_{eff}$ is always lower than $Q_{th}$. The larger the value of $\eta$, the better the compression characteristic of a Roots vacuum pump. A relatively high value of $\eta$ could for example be obtained by small gaps at the "point of contact" on the one hand and between rotors and housing of the pump chamber on the other hand. However, small gaps result in a high temperature sensitivity of the pump. The reason for this is, that the amount of heat which may be removed from the rotors rotating in the vacuum is limited. In the case of small gaps a small temperature increase of the rotors reduces the gap and thus prevents the rotors from starting up.

With respect to optimized characteristics of a Roots vacuum pump values for $\mu$ and $\eta$ which are as high as possible are very desirable.

At the same time it has to be borne in mind that complex manufacturing methods are employed especially for the rotors due to their special profile contours and the small gaps. Because of the complex manufacturing methods it has to date been usually more cost-effective to manufacture large Roots machines with sub-optimum $\mu$ and $\eta$ values, rather than smaller machines with better values for $\mu$ and $\eta$ with otherwise identical performance characteristics.

For further details on the current state of the art refer to the book by G. Niemann and H. Winter "Maschinenelemente", Vol. 2, 1985 as well as the already quoted publication CH-PS 389 817. These references show on the one hand that numerous profile contours for rotors are known (CH-PS) but which mostly not have been able to gain success in the market. On the other hand these references show that the profile contour of Roots blowers and pumps which are well established in the market are produced with the aid of roulettes (cycloids, involutes) (CH-PS 389 817, FIG. 2; "Maschinenelemente", Vol 2, p. 142). The efficiency of area $\mu$ of Roots pumps with such rotors hardly exceeds 50%.

Moreover, a profile contour of a rotor is disclosed in CH-PS 389 817 where the longer sides of the profile at the base are made to run in parallel (straight rotors). According to the aforementioned CH patent publication this contour makes it possible to obtain a relatively low ultimate pressure, but at the expense of a considerable reduction in the efficiency of area $\mu$, as the effective pumping area F of the rotor is larger in the case of rotors having a waist compared to pumps with straight rotors (compare this to the areas 9 or 32 in FIGS. 4*b* and 6*b* of CH-PS 389 817). Machines with rotor profile contours of the type proposed in CH-PS 389 817 are therefore fairly large, correspondingly heavy and consequently relatively costly.

SUMMARY OF THE INVENTION

It is the object of the present invention to improve the profile contour for rotors of a Roots vacuum pump.

These and other objects are accomplished by the characteristic features of the patent claims. By applying these features one fist obtains the contour for the base of the first rotor as well as the contour of the profile section for the top of the corresponding second rotor. As these sections are identical or symmetrical to the remaining profile sections at the base and top—this being due to the use of identical rotors—the entire profile contour of the rotors for a Roots machine may be developed.

The efficiency of area $\mu$ for a machine of this type is high (62% and more). At a given pumping speed, the high efficiency of area $\mu$ results in a relatively small cross sectional area Q and thus a compact and cost-effective design.

At the same time volumetric efficiency $\eta$ is high for a Roots vacuum pump with rotors designed according to the invention. The reason for this is, that the slope of the profile at the base of the waist is kept flat (at small values for $\rho$). This results in favourable osculation values between the rotors themselves and also between the rotors and the wall of the pumping chamber. Here osculation is defined as the ratio between the radii of curvature of the surfaces which form the gap. In the case of favourable osculation values the radii of curvature do not differ very much from each other. This practically extends the length of the gap between the rotors themselves as well as between the rotors and the pump chamber, resulting in a lower backstreaming rate. This extension of the gaps does not have an influence on the temperature characteristics of the pump.

A factor which also contributes to the reduction of the backstreaming rates and thus the improvement of volumetric efficiency is, that in spite of the high values for $\mu$, the "point of contact" on the line of action performs a continuous motion, i.e. a motion without backstep or discontinuity (sudden skipping of larger sections of the profile), so that during the entire rolling cycle there are no dead volumes or other undesirable spaces present, which might trap or shift volumes.

The profile contour of rotors according to the invention is uniform and continuous, resulting in considerable advantages during manufacture. Sudden changes in the slopes do not occur. A minimum radius of curvature (required for the tool machine) is always maintained.

BRIEF DESCRIPTION OF THE DRAWINGS

Further objects, advantages and details of the present invention will become apparent from the following detailed description taken in conjunction with the drawings wherein.

DESCRIPTION OF THE PREFERRED EMBODIMENTS

Figure 3:
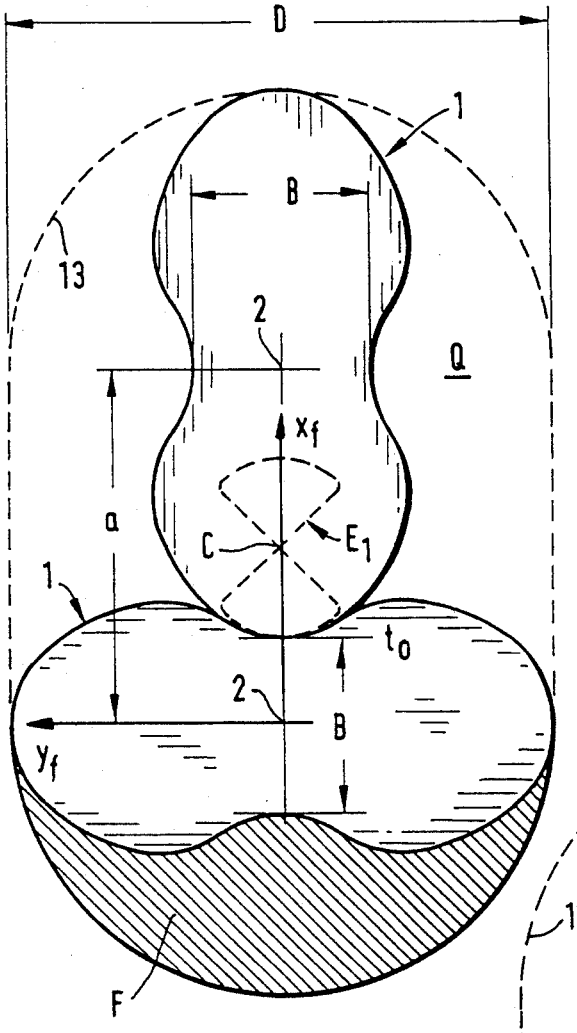
Figure 4:
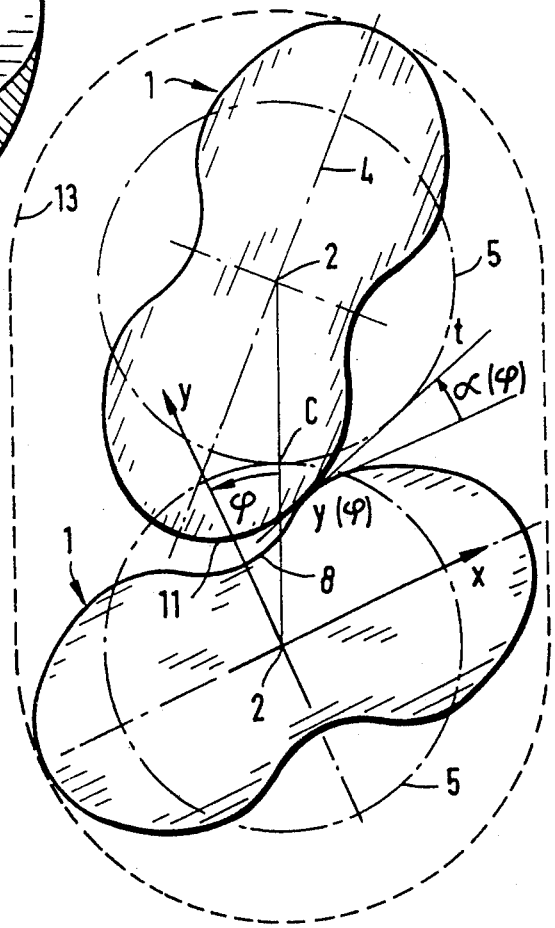
Figure 5:
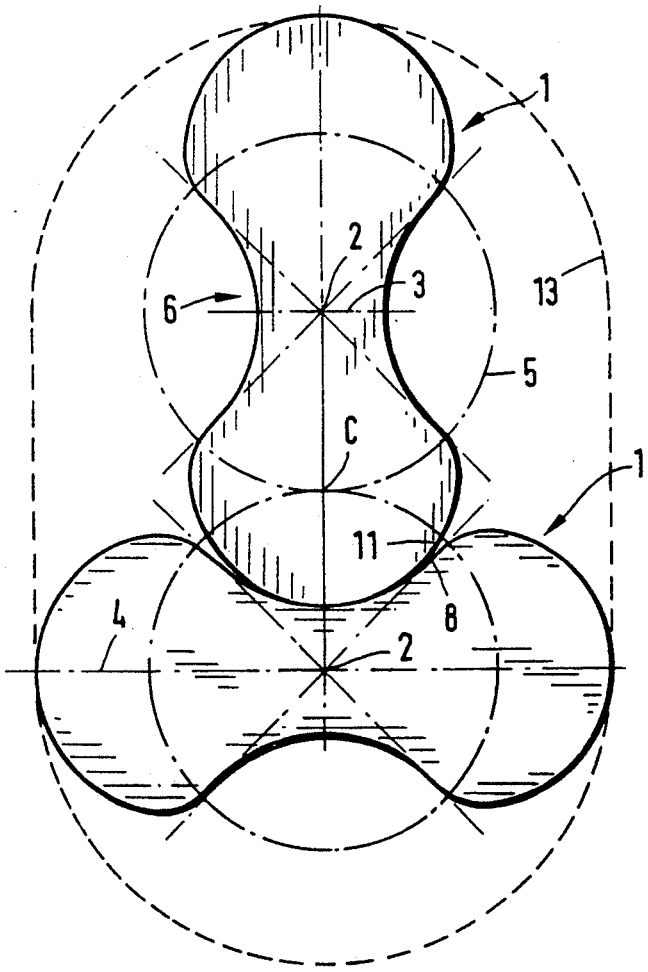
FIG. 5 is a view similar to FIG. 4 of a rotor profile according to the present invention.

The drawing FIG. 5 is a schematic representation of a pair of rotors according to the invention. Area of efficiency $\mu$ is 64%. The slope at the base of the waist is flat over a relatively wide range. From this it is obvious that osculation of the rotors with respect to each other and with respect to the envelope is improved compared to state of the art rotors. As noted above in reference to FIG. 3, $f(\zeta)=a(\zeta)$.

Figure 6:
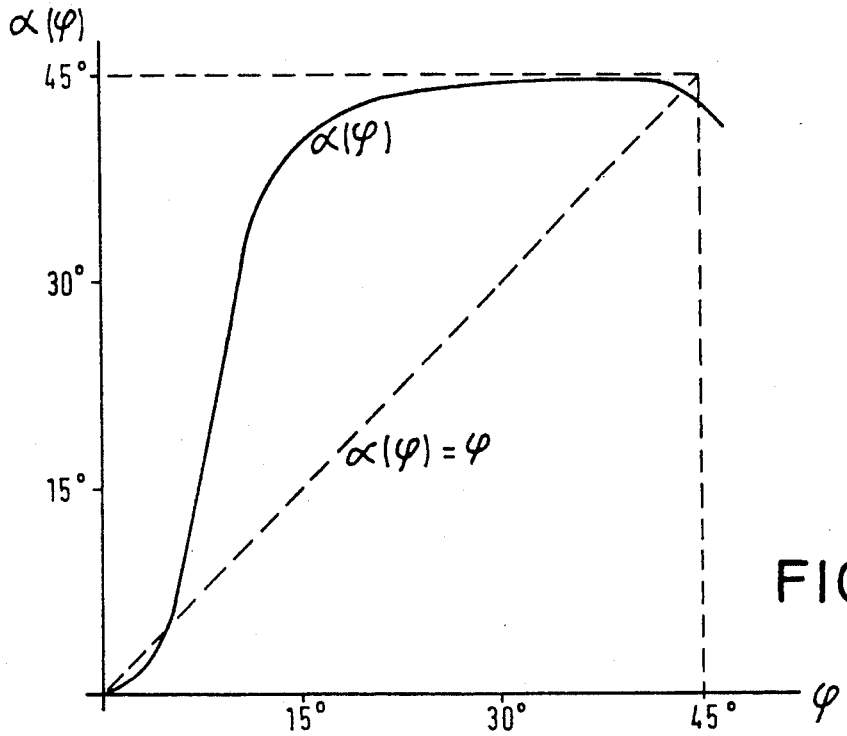
FIG. 6 is a graphic representation of the curve $a(\rho)$ as a function of the angle of rotation for the rotor of FIG. 5.

Shown in FIG. 6 is the path of the curve $a(\rho)$ as a function of an angle of rotation $\rho$ between 0° and 45°. Except for the starting and ending area (each 5° approx.) $a(\rho)$ is larger than $\rho$. The angle of inclination a $(\zeta)$ of the tangent is generally greater than 40 degrees for values of $(\zeta) \geqq 15°$. The straight line $a(\rho)=\rho$is shown dotted.

Figure 1A:
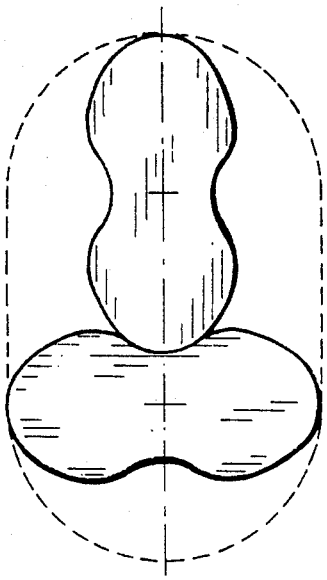
FIG.1a Prior Art
FIGS. 1(*a–c*) are diagrammatic representations of three prior art rotor profiles.
Figure 1B:
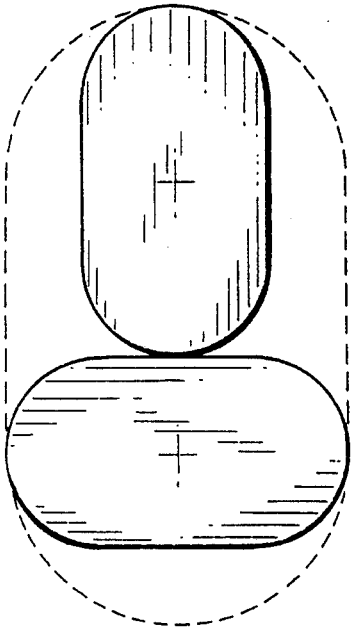
FIG.1b Prior Art
Figure 1C:
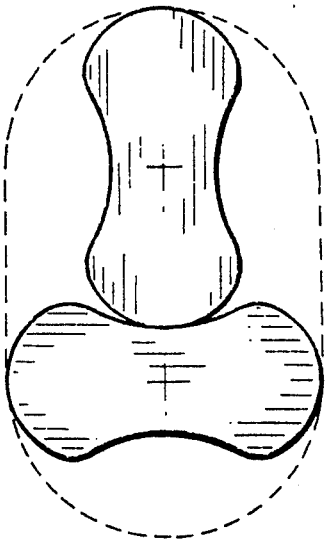
FIG.1c Prior Art
Figure 2:
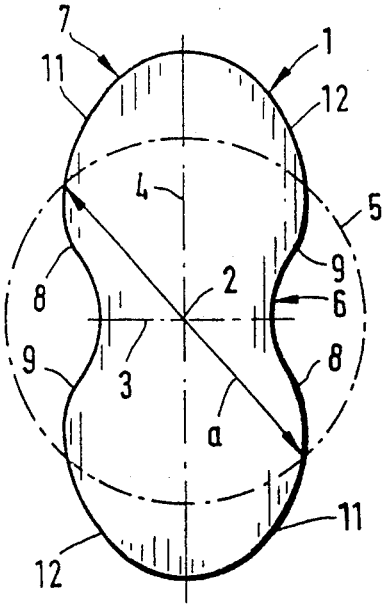
FIG.2 Prior Art
FIGS. 2–4 are views similar to FIG. 1 detailing the relationship of the rotor profile of FIG. 1*a;*
Figure 7:
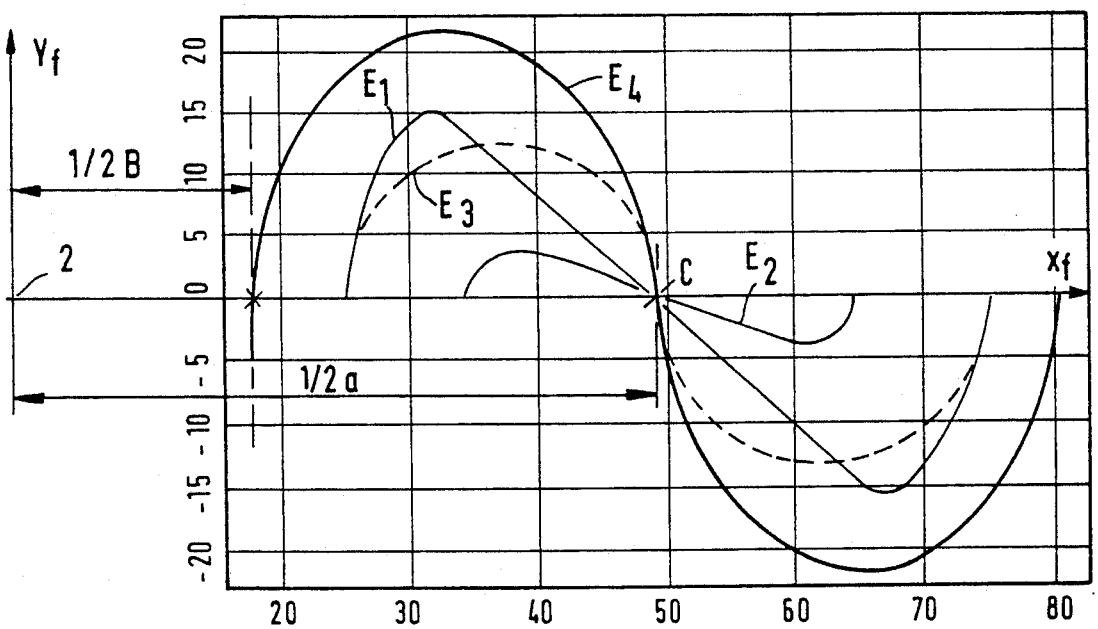
FIG. 7 is a graphic representation of the lines of action for various rotor profiles.

Shown in FIG. 7 are the lines of action $E_1$, $E_2$, $E_3$ and $E_4$ in the fixed system of coordinates $x_f$, $y_f$. Half of the waist width B and half of the rolling cycle diameter are shown. Lines of action $E_1$, $E_2$, $E_3$ belong to state of the art rotor profiles, namely $E_1$ belongs to a rotor profile according to FIG. 1*a*, $E_2$ belongs to a rotor profile according to FIG. 1*b*, $E_3$ belongs to a rotor profile according to FIG. 1*c*.

The outer line of action $E_4$ which closely resembles a sinusoid is that of the especially advantageous design of a rotor profile based on the invention, i.e. it is expedient to select a rotor profile contour according to the invention so that the related line of action $E_4$ has a maximum amplitude and resembles a sinusoid.

After defining the shape of profile contour sections 8, 11 according to the present invention, the shape of the remaining contour sections 9, 12 and thus the entire rotor is determined, as the other sections of the contour are identical or symmetrical to sections 8, 11. In order to introduce an application-specific degree of play (gap width) the profile contour may be provided with equidistant lines depending on the angle of rotation and the particular requirements. The profile contour dimensions are reduced equally to provide the desired clearance between the two rotors.

The rotor profile contour shown in FIG. 5 may be defined in accordance with the following expression. The profile contours 8 at the base of the rotors are defined relative to an x-y coordinate system with respect to the rotor by the value of y varying between 0.5a and (1-2/2)a where a=the rolling circle diameter; (for the condition $\rho=x=o$ this corresponds to one-half the shorter rotor diameter B:) and the angle of inclination of the tangent $a(\rho)$ varies between $\rho=0$ and $\rho=45°$ according to the following table:

| | | |
|---|---|---|
| 0°-5° | approximately | $a(\rho) < \rho$ |
| 5°-40° | approximately | $a(\rho) > \rho$ |
| 40°-45° | approximately | $a(\rho) < \rho$ |

The contour 9 is the inverse of the contour 8 as defined above and the contours at the top of the rotors 11 and 12 are defined as being the convex congruent of the respective concave base contour adjusted for the desired clearance between rotors.

The application of rotors, the profile contour of which is produced according to the invention, in Roots vacuum pumps leads to an optimized solution with considerable advantages compared to the current state of the art. Despite of the relatively high area of efficiency, a continuous and steady contour is achieved where minimum radii of curvature are avoided. This results not only in a compact design (smaller and lightweight) but also simplifies the manufacturing process. Improved osculation and the relatively even motion of the profiles "point of contact" result in a favourable volumetric efficiency. In all an improvement in the pumping characteristics is achieved while at the same time reducing manufacturing costs.

What is claimed is:

1. A rotor for a Roots type vacuum pump having two identical rotors which exhibit a basically figure eight shaped profile contour and includes four profile sections at the base and four profile sections at the top comprising in combination:

A) a first profile contour at the base of the rotor defined by an (x, y, $\rho$) system of coordinates relative to the rotor as follows:

i) the value of y which corresponds to $\frac{1}{2}$ of the shorter rotor diameter B at $\rho=x=0$ lies between 0.5 a and $(1=\sqrt{2}/2)$ a where a=the rolling circle diameter;

ii) the angle of inclination of the tangent $a(\rho)$ progresses between $\rho=0°$ and $\rho=45°$ as follows:
up to 5° approx. $a(\rho)<\rho$
from 5° to 40° approx. $a(\rho)>\rho$
from 40° to 45° approx. $a(\rho)<\rho$; and B) a second profile contour at the top of the rotor corresponding to the profile at the base of the rotor and to the rolling projection of the contour of the profile of the base.

2. A rotor for a Roots type vacuum pump according to claim 1 wherein the angle of inclination $a(\rho)$ of the tangent is greater than 40° for values of $\rho \geqq 15°$.

3. A rotor for a Roots type vacuum pump according to claim 1 wherein a $(\rho)=f(\rho)$.

4. A rotor for a Roots type vacuum pump according to claim 1 wherein said first and second profile contour dimensions are reduced equally to provide the desired clearance between the two rotors.

5. A rotor for a Roots type vacuum pump according to claim 1 wherein the first and second profile contour dimensions are selected to produce a line of action substantially corresponding to a sinusoid.

* * * * *